US008287245B2

(12) United States Patent
Tolbert, Jr.

(10) Patent No.: US 8,287,245 B2
(45) Date of Patent: Oct. 16, 2012

(54) SYSTEM AND METHOD FOR CONTROL OF DEVICES INTERNAL TO A HERMETIC COMPRESSOR

(75) Inventor: John W. Tolbert, Jr., Bristol, TN (US)

(73) Assignee: Bristol Compressors International, Inc., Bristol, VA (US)

( * ) Notice: Subject to any disclaimer, the term of this patent is extended or adjusted under 35 U.S.C. 154(b) by 244 days.

(21) Appl. No.: 12/878,982

(22) Filed: Sep. 9, 2010

(65) Prior Publication Data

US 2010/0329894 A1 Dec. 30, 2010

Related U.S. Application Data

(63) Continuation-in-part of application No. 11/428,942, filed on Jul. 6, 2006, now abandoned.

(51) Int. Cl.
*F04B 49/06* (2006.01)
*G08B 1/08* (2006.01)

(52) U.S. Cl. ..... 417/44.1; 340/538.11

(58) Field of Classification Search ..... 340/310.11, 340/310.12, 538, 538.11; 417/44.1, 213, 417/415, 12; 62/228.1, 228.4
See application file for complete search history.

(56) References Cited

U.S. PATENT DOCUMENTS

| | | | | |
|---|---|---|---|---|
| 3,167,293 | A | 1/1965 | Stenger et al. | |
| 3,702,460 | A | 11/1972 | Blose | |
| RE31,023 | E | 9/1982 | Hall, III | |
| 4,364,110 | A | 12/1982 | Hyatt | |
| 4,514,594 | A | 4/1985 | Brown et al. | |
| 4,644,320 | A | 2/1987 | Carr et al. | |
| 4,742,475 | A | 5/1988 | Kaiser et al. | |
| 5,096,390 | A | 3/1992 | Sevrain et al. | |
| 5,200,872 | A | 4/1993 | D'Entremont et al. | |
| 5,321,849 | A | 6/1994 | Lemson | |
| 5,951,394 | A | 9/1999 | Pariseau | |
| 6,047,556 | A | 4/2000 | Lifson | |
| 6,047,557 | A | 4/2000 | Pham et al. | |
| 6,182,457 | B1 | 2/2001 | Enderie | |
| 6,302,654 | B1 * | 10/2001 | Millet et al. | 417/63 |
| 6,374,624 | B1 | 4/2002 | Cholkeri et al. | |
| 6,457,948 | B1 | 10/2002 | Pham | |
| 6,499,305 | B2 | 12/2002 | Pham et al. | |
| 6,587,037 | B1 | 7/2003 | Besser et al. | |
| 6,847,297 | B2 | 1/2005 | Lavoie et al. | |
| 6,870,465 | B1 | 3/2005 | Song | |
| 6,882,125 | B2 | 4/2005 | Kameda et al. | |
| 6,897,764 | B2 | 5/2005 | Cern | |
| 6,906,618 | B2 | 6/2005 | Hair, III et al. | |
| 6,964,558 | B2 | 11/2005 | Hahn et al. | |
| 7,163,158 | B2 | 1/2007 | Rossi et al. | |

(Continued)

*Primary Examiner* — Devon Kramer
*Assistant Examiner* — Nathan Zollinger
(74) *Attorney, Agent, or Firm* — McNees Wallace & Nurick LLC

(57) ABSTRACT

A system is provided for transmitting control signals to the internal devices of a compressor. The compressor includes a housing, a hermetic power terminal and a motor for powering the compressor. The system includes a frequency converter that is located external to the compressor housing and a frequency decoder that is positioned inside the compressor housing. The frequency converter can convert a control signal from a controller to a high frequency signal. The frequency decoder decodes and converts the high frequency signal to a control signal for an internal device of the compressor. An AC input power source provides electrical power to the motor, and power transmission lines connect the AC input power source to the hermetic power terminal. The frequency converter is electrically coupled to the frequency decoder by two power transmission lines.

20 Claims, 6 Drawing Sheets

U.S. PATENT DOCUMENTS

| | | | |
|---|---|---|---|
| 7,434,744 | B2 | 10/2008 | Garozzo et al. |
| 7,491,034 | B2 | 2/2009 | Jayanth |
| 2001/0052843 | A1 | 12/2001 | Wiesman et al. |
| 2002/0154000 | A1 | 10/2002 | Kline |
| 2003/0190110 | A1 | 10/2003 | Kline |
| 2004/0201493 | A1 | 10/2004 | Robertson |
| 2005/0066673 | A1 | 3/2005 | Monk et al. |
| 2005/0188706 | A1 | 9/2005 | Tokushige et al. |
| 2008/0272904 | A1 | 11/2008 | Atherton |

* cited by examiner

SYSTEM AND METHOD FOR CONTROL OF DEVICES INTERNAL TO A HERMETIC COMPRESSOR

CROSS REFERENCE TO RELATED APPLICATIONS

This application is a continuation-in-part of U.S. application Ser. No. 11/428,942 filed Jul. 6, 2006, which is incorporated by reference herein.

BACKGROUND

The present application relates to providing control signals to internal components of hermetic compressors, and more specifically to the controlling of internal components in a hermetic compressor by the use of control signals transmitted on the power lines of the motor of the hermetic compressor.

The operation of hermetic compressors can be controlled through the use of control devices, e.g., solenoids, that are located inside of the housing of the hermetic compressor. By way of example, without limitation, capacity modulation can be controlled in some compressors by a solenoid-actuated valve. Also, an internal bleed valve controlled by an electromagnetic solenoid actuator may be used for pressure equalization on the start-up of the compressor. A controller positioned outside of the hermetic compressor can be used to operate and control the internal control devices of the hermetic compressor.

At least two control wires can be needed to provide actuation control signals from the controller or control panel to a solenoid actuator. To provide the control signals from the controller to the internal control devices of the hermetic compressor, hermetically sealed terminals, one for each control wire, can be used to provide a connection through the housing. The use of the hermetically sealed terminals to provide control signals inside the housing of the hermetic compressor is in addition to the use of a set of hermetically sealed terminals to provide the main supply voltage, e.g., an AC (alternating current) voltage, to the motor inside the housing of the hermetic compressor. The use of additional hermetically sealed terminals for the control wires adds to the manufacturing cost of the compressor, and increases the chances that the hermetic seal of the compressor may be compromised.

Therefore, what is needed is a simple and inexpensive technique to provide control signals to the internal devices in a compressor without the use of dedicated terminals.

SUMMARY

The present application is directed to a system for transmitting control signals to internal devices of a compressor. The compressor includes a housing, a sealed power terminal, and a motor for powering the compressor. The system includes a first signal converter disposed externally of the compressor housing. The first signal converter is configured to receive a control signal and convert the control signal to a modulated signal. A second signal converter is disposed internally of the compressor housing. The second signal converter is configured to decode the modulated signal. A plurality of power transmission lines is connected to an AC input power source. The plurality of power transmission lines is connected to the sealed power terminal. The first signal converter is electrically coupled to at least one of the power transmission lines to transmit the modulated signal to the second signal converter. The second signal converter is coupled to at least one power transmission line. The second signal converter is configured to receive the modulated signal and generate a driver signal in response to the modulated signal for operating at least one of the internal devices of the compressor.

In another embodiment, the application is directed to a refrigeration system. The refrigeration system includes a compressor, a condenser, and an evaporator connected in a closed refrigerant loop. The compressor has a motor to power the compressor. The compressor includes a housing and a hermetic power terminal A frequency converter is disposed externally of the compressor housing. The frequency converter is configured to receive a control signal and convert the control signal to a high-frequency signal. A frequency decoder is disposed internally of the compressor housing. The frequency decoder is configured to decode the high-frequency signal and convert the high-frequency signal to a driver signal. A plurality of power transmission lines is connected to the hermetic power terminal. The frequency converter is electrically coupled to at least one power transmission line of the plurality of transmission lines to transmit the high-frequency signal to the frequency decoder. The frequency decoder is coupled to at least one power transmission line and configured to receive the high-frequency signal and generate a driver signal in response to the high-frequency signal for operating at least one of the internal devices of the compressor.

In another embodiment, the application is directed to a method for controlling internal devices of a hermetic compressor wherein the compressor includes a housing, a hermetic power terminal and a motor for powering the compressor. The method includes generating a control signal, converting the control signal to a high-frequency signal, transmitting the high-frequency signal on an AC input power line of the compressor, decoding the high-frequency signal, generating a driver signal in response to the decoded high-frequency signal, and controlling an internal device with the generated driver signal.

A further embodiment of the application is directed to a system for transmitting control signals to internal components of a compressor. The compressor includes a hermetically sealed housing and a motor positioned inside the hermetically sealed housing. The system includes a first signal converter located external to the hermetically sealed housing and a second signal converter located internal to the hermetically sealed housing. The first signal converter is configured to receive a control signal and convert the control signal to an output signal. The second signal converter is configured to decode the output signal and generate a control signal for an internal component of the compressor. The system also includes a power terminal configured and positioned to provide a hermetically sealed electrical connection through the housing, a plurality of power lines connectable to a power source to provide an operating voltage to the motor, and a plurality of motor leads positioned inside the hermetically sealed housing. The plurality of power lines are connected to the power terminal external to the hermetically sealed housing and the plurality of motor leads are connected to the power terminal at one end and to the motor at an opposite end. The first signal converter is electrically coupled to at least one power line of the plurality of power lines to transmit the output signal through the at least one power line and the power terminal to the plurality of motor leads. The second signal converter is electrically coupled to at least one motor lead of the plurality of motor leads to receive the output signal and the at least one motor lead is connected to the power terminal at a location corresponding to the connection of the at least one power line of the plurality of power lines to the power terminal.

Still another embodiment of the application is directed to a system including a compressor having a hermetically sealed housing, a motor positioned in the hermetically sealed housing, and a hermetic power terminal configured and positioned to provide a sealed electrical connection through the hermetically sealed housing. The system also includes a plurality of first power lines connectable to an AC power source at one end and connected to the hermetic power terminal at an opposite end, an encoder located external to the hermetically sealed housing, a plurality of second power lines positioned inside the hermetically sealed housing, and a decoder located internal to the hermetically sealed housing. The AC power source is configured to provide a voltage greater than 100 volts. The encoder is configured to receive a first signal and convert the first signal to a second signal. The encoder is connected to at least one first power line of the plurality of first power lines to transmit the second signal on the at least one first power line. The plurality of second power lines is connected to the hermetic power terminal. The decoder is connected to at least one second power line of the plurality of second power lines to receive the second signal from the at least one second power line. The decoder is configured to receive the second signal and generate a third signal from the second signal. The third signal corresponds to the first signal. The system also includes a component located internal to the hermetically sealed housing and controlled by the third signal from the decoder. The connection of the at least one first power line to the power terminal corresponds to the connection of the at least one second power line to the power terminal.

Yet another embodiment of the application is directed to a method for controlling an internal device of a hermetic compressor. The compressor includes a housing, a hermetic power terminal providing an electric connection through the housing and a motor positioned in the housing. The method includes receiving a control signal for an internal device of a hermetic compressor, converting the control signal to an output signal at a location external to a housing of the hermetic compressor, and transmitting the output signal on an AC power line through a hermetic power terminal into the interior of the housing. The output signal has a frequency in the range between about 10 KHz and about 100 MHz. The method also includes receiving the output signal at a location internal to the housing, generating a driver signal based on the received output signal, and controlling the internal device of the hermetic compressor using the generated driver signal.

An advantage of the present application is that a dual capacity compressor may be controlled without the use of external starting devices by unloading the high pressure side of the compressor to lower the required motor starting torque.

Another advantage of the present application is that a modulated capacity compressor may be modulated without additional hermetic terminals.

A further advantage of the present application is that by using the motor leads and input AC power lines to transmit the control signal inside the compressor, it is not necessary to create additional hermetic terminals in the compressor for control signal wiring, thereby avoiding the expense of the additional hermetic terminals that would otherwise be required.

Other features and advantages of the present application will be apparent from the following more detailed description of the exemplary embodiments, taken in conjunction with the accompanying drawings which illustrate, by way of example, the principles of the application.

BRIEF DESCRIPTION OF THE DRAWINGS

Wherever possible, the same reference numbers will be used throughout the drawings to refer to the same or like parts.

DETAILED DESCRIPTION

Figure 1:
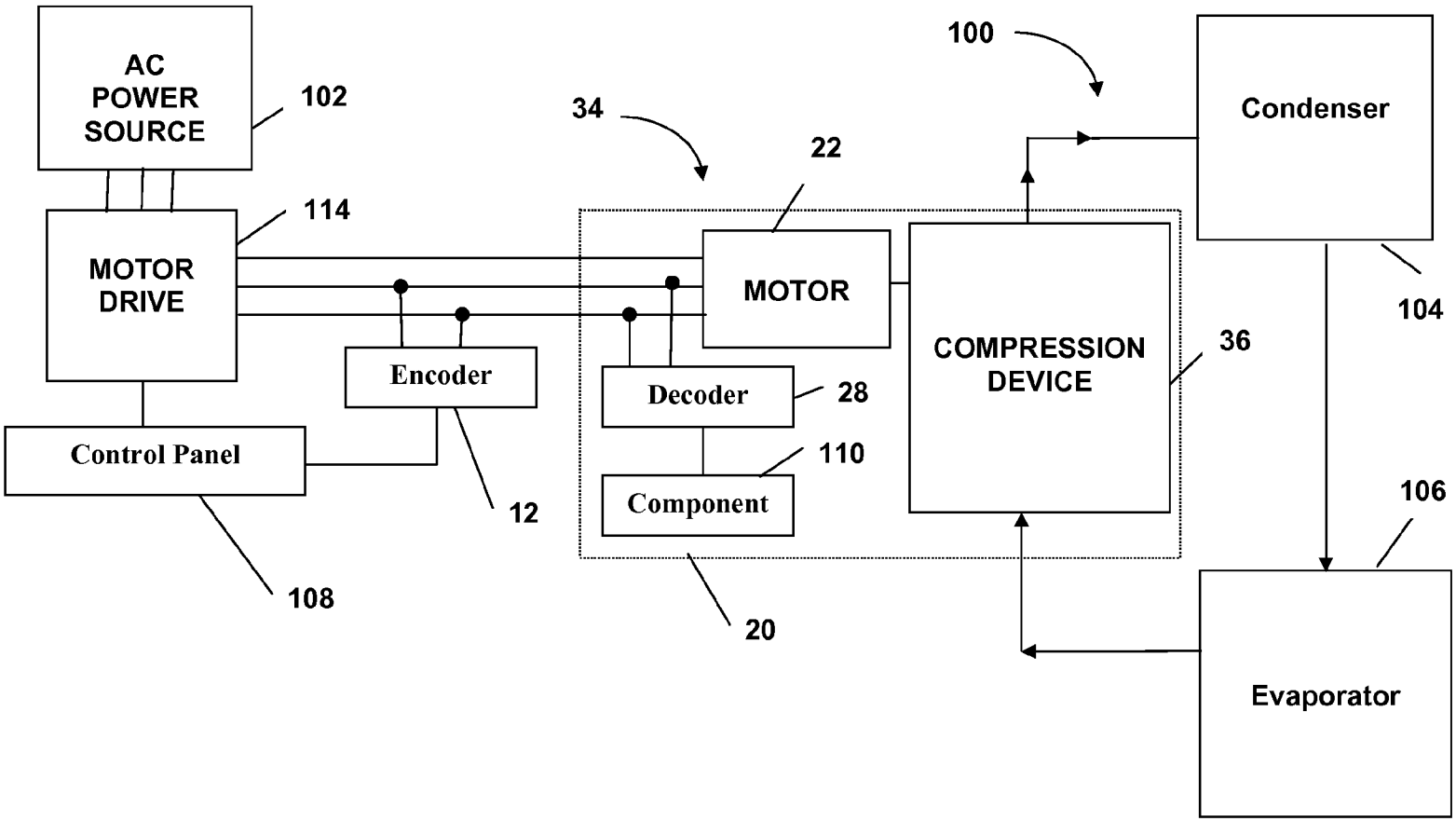
FIGS. 1 and 2 schematically show exemplary embodiments of vapor compression systems.
Figure 2:
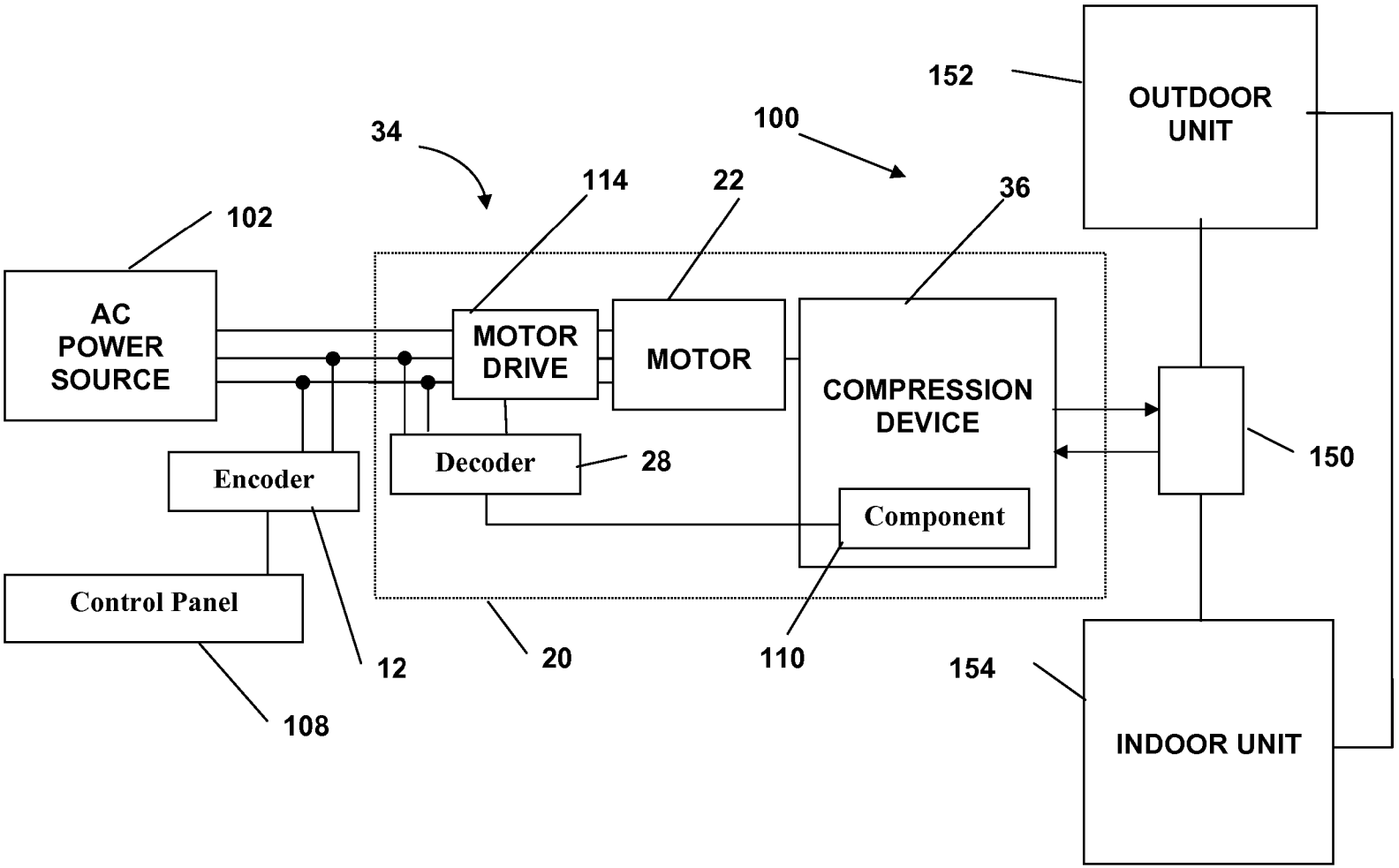

As shown in FIGS. 1 and 2, a vapor compression system, such as a heating, ventilation, air conditioning and refrigeration (HVAC&R) system 100, can include a compressor 34, a condenser 104, and an evaporator 106 (see FIG. 1) or a compressor 34, a reversing valve 150, an indoor unit 154 and an outdoor unit 152 (see FIG. 2). The system 100 can be operated as an air conditioning only system, where the evaporator 106 can be located indoors, i.e., as indoor unit 154, to provide cooling to the indoor air and the condenser 104 can be located outdoors, i.e., as outdoor unit 152, to discharge heat to the outdoor air. The system 100 can also be operated as a heat pump system with the inclusion of the reversing valve 150 to control and direct the flow of refrigerant from the compressor 34. When the heat pump is operated in an air conditioning mode, the reversing valve 150 is controlled for refrigerant flow as described above for an air conditioning system. However, when the heat pump is operated in a heating mode, the flow of the refrigerant is in the opposite direction from the air conditioning mode and the condenser 104 can be located indoors, i.e., as indoor unit 154, to provide heating of the indoor air and the evaporator 106, i.e., as outdoor unit 152, can be located outdoors to absorb heat from the outdoor air.

Referring back to the operation of the system 100, whether operated as a heat pump or as an air conditioner, a compression device 36 of the compressor 34 is driven by a motor 22 that can be powered by a motor drive 114 or directly from an AC power source 102. A control panel or controller 108 can be used to control the operation of the motor drive 114 (if used), the motor 22 and/or the compressor 34. In another exemplary embodiment, the control panel or controller 108 can be used to control other components of system 100, e.g., reversing valve 150. The control panel 108 can include a variety of different components such as an analog to digital (A/D) converter, a microprocessor, a non-volatile memory, and an interface board.

The motor drive 114 can be a variable speed drive (VSD) or variable frequency drive (VFD) that receives AC power having a particular fixed line voltage and fixed line frequency from the AC power source 102 and that provides power to the motor 22 at a desired voltage and desired frequency (including providing a desired voltage greater than the fixed line voltage and/or providing a desired frequency greater than the fixed line frequency), both of which can be varied to satisfy particular requirements. Alternatively, the motor drive 114 can be a "stepped" frequency drive that can provide a predetermined number of discrete output frequencies and voltages, i.e., two or more, to the motor 22.

The motor drive 114 can be located or positioned outside of the compressor 34 (see FIG. 1) or the motor drive 114 can be located or positioned inside of the compressor 34 (see FIG. 2). If located inside compressor 34, motor drive 114 can include suitable enclosures and or sealing mechanisms in order to prevent the refrigerant, oil and other substances inside of the compressor 34 from damaging the components of the motor drive 114.

The AC power source 102 can provide single phase or multi-phase (e.g., three phase), fixed voltage, and fixed frequency AC power to the motor drive 114. The motor drive 114 can accommodate virtually any AC power source 102, such as an AC power source 102 that can supply an AC voltage or line voltage in the range between 100 and 600 volts AC (VAC), for example, 187 VAC, 208 VAC, 230 VAC, 380 VAC, 460 VAC, or 600 VAC, at a line frequency of 50 Hz or 60 Hz. In another exemplary embodiment, the AC power source 102 can provide power directly to the motor 22. In still another exemplary embodiment, the power source can be a DC (direct current) power source that can supply a DC voltage in the range between 12 and 600 volts DC (VDC) to the motor.

The motor 22 used in the system 100 can be any suitable type of motor that can be powered by a motor drive 114 or directly from the AC power source 102 (or a DC power source). The motor 22 can be any suitable motor type including an induction motor, a switched reluctance (SR) motor, or an electronically commutated permanent magnet motor (ECM).

Referring back to FIGS. 1 and 2, the compressor 34 compresses a refrigerant vapor and delivers the vapor to the condenser 104 through a discharge line (and the reversing valve 150 if operated as a heat pump). The compressor 34 can be any suitable compressor including a reciprocating compressor, rotary compressor, screw compressor, swing link compressor, scroll compressor, or a turbine compressor. The refrigerant vapor delivered by the compressor 34 to the condenser 104 enters into a heat exchange relationship with a fluid, e.g., air or water, and undergoes a phase change to a refrigerant liquid as a result of the heat exchange relationship with the fluid. The condensed liquid refrigerant from the condenser 104 flows through an expansion device (not shown) to the evaporator 106.

The liquid refrigerant delivered to the evaporator 106 enters into a heat exchange relationship with a fluid, e.g., air or water, and undergoes a phase change to a refrigerant vapor as a result of the heat exchange relationship with the fluid. The vapor refrigerant in the evaporator 106 exits the evaporator 106 and returns to the compressor 34 by a suction line to complete the cycle (and the reversing valve 150 if operated as a heat pump). It is to be understood that any suitable configuration of the condenser 104 and the evaporator 106 can be used in the system 100, provided that the appropriate phase change of the refrigerant in the condenser 104 and evaporator 106 is obtained.

Figure 3:
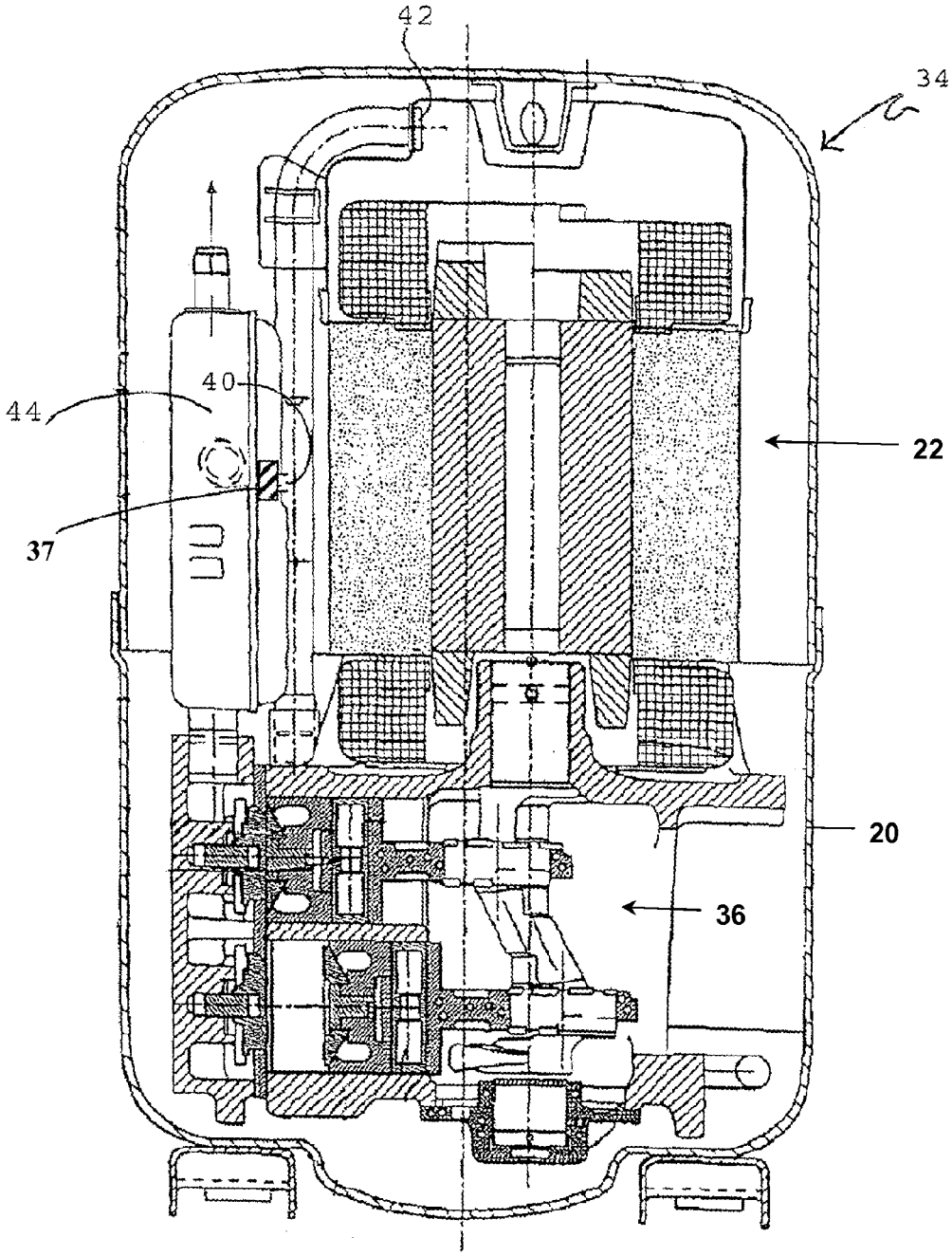
FIG. 3 shows a cross-sectional view of a hermetic compressor.

In one exemplary embodiment, as shown in FIG. 3, the compressor 34 can include a housing 20 that hermetically encloses the motor 22 and compression device 36. The hermetic enclosure provided by the housing 20 prevents air, refrigerant or other fluids from passing into or out of the housing 20. Since housing 20 provides a hermetic seal, the interior or inside of housing 20 can be pressurized and operated at an internal pressure that is greater than atmospheric pressure. In one exemplary embodiment, the inside of housing 20 can receive refrigerant from evaporator 106 and have an internal pressure that corresponds to the evaporator pressure (or suction pressure) of the refrigerant in the system 100.

In addition to the compression device 36 and motor 22, other components 110 can be included in the housing 20 that are used in the operation of compressor 34. Components 110 can include protection devices for the motor 22 and/or compression device 36, an electromechanical capacity modulating device, e.g., a solenoid, or an internal oil sump heater. Each of the components 110 located inside of the housing 20 require control signals from a control panel or controller for proper operation and control. In another exemplary embodiment, a motor drive 114 located inside of the housing 20 can require the providing of control algorithms or signals, similar to components 110, to ensure that motor drive 114 provides the appropriate voltage to control the motor 22.

Figure 4:
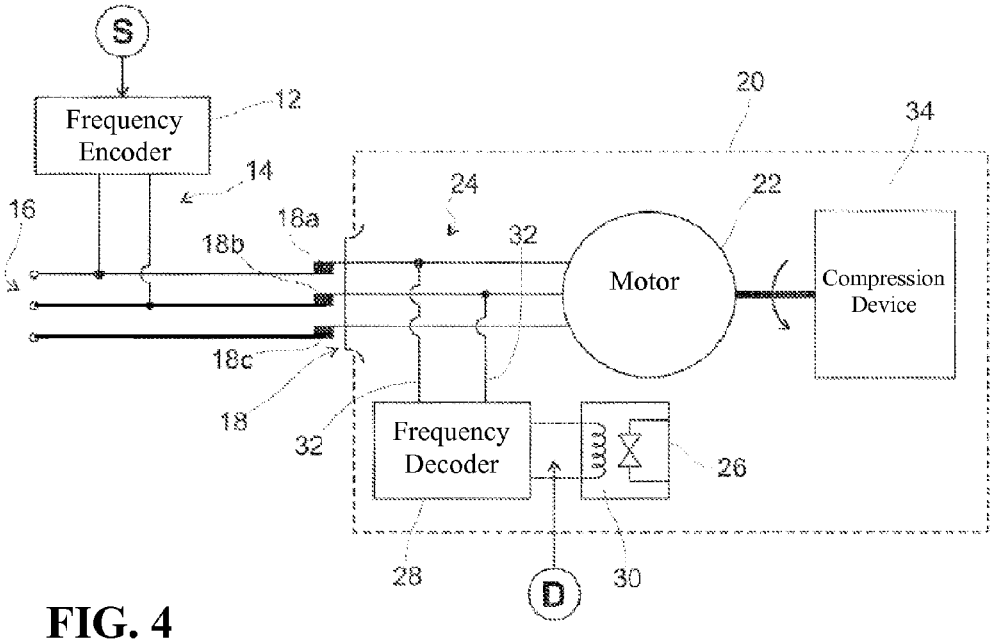
FIGS. 4 and 5 schematically show a control system used in conjunction with different embodiments of compressor terminals.
Figure 5:
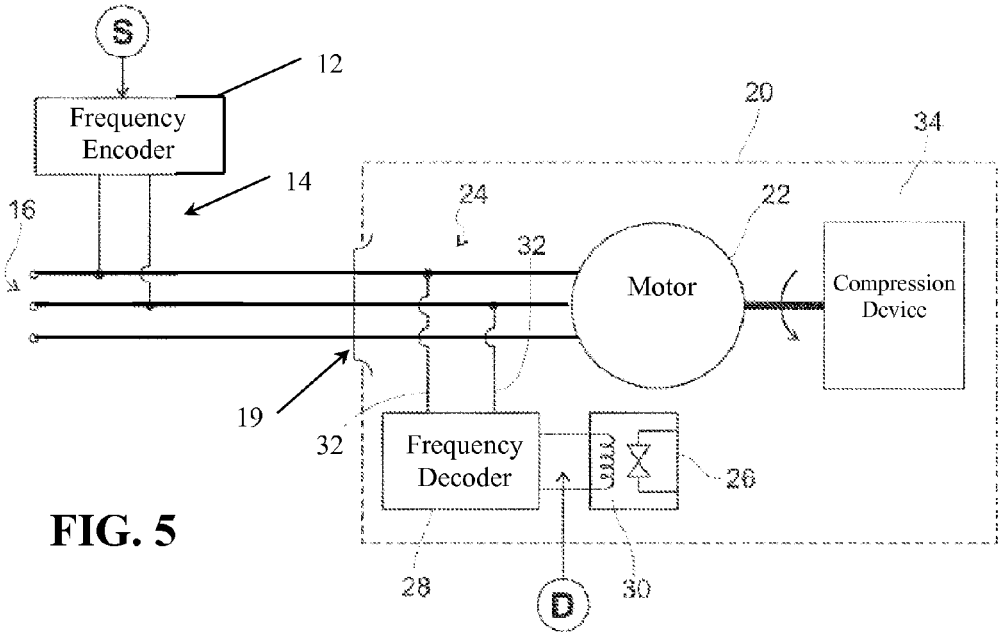

In FIGS. 4 and 5, control systems are shown for transmitting control signals to components, e.g., an internal solenoid valve 26 for modulating the capacity of the compressor 34, located inside of housing 20. The control signals provided by the control system are provided through the housing to the internal components via power terminals positioned in the hermetic housing 20. The power terminals are designed to maintain the hermetic seal of the housing 20 and are used to transmit the appropriate power to the motor 22 or motor drive 114, if located inside the housing 20.

A control signal S, e.g., a capacity modulation signal or a solenoid energizing signal, for an internal component is input to a converter or encoder 12. The signal S provided to the converter 12 can be a predetermined control voltage, in the range of 24 VAC to 230 VAC. The signal S can be generated by the control panel 108 either automatically or manually depending on the control scheme or algorithm used for compressor 34. In one embodiment, the converter 12 can be configured to convert the control signal S to an output signal having a frequency greater than the line frequency of the AC power supply 102 and a voltage in the range from a few millivolts to 20 volts. The output 14 of the converter 12 can be connected to an input AC power line 16 extending from the AC power supply 102 to the compressor 34. The output 14 can be connected across a power conductor and a neutral conductor, or across two power conductors. In another exemplary embodiment, the output 14 of the converter 12 can be connected between two phases of a three-phase power supply on input AC power line 16. In a further embodiment, the output 14 of the converter 12 can be connected to any one of the power terminal inputs and a conductor connected to the compressor housing that serves as a signal return path, i.e., ground. In addition, if required, additional lugs for grounding and neutral connections may also be provided. The various arrangements described here for connecting the converter to the input conductors are exemplary and not intended as limiting. Those skilled in the art will appreciate that other coupling arrangements for connecting the converter 12 to the input AC power lines may be employed within the spirit and scope of the present application.

In FIG. 4, the input AC power line 16 is connected to a hermetic power terminal 18 mounted on the compressor housing 20. The hermetic power terminal 18 provides a sealed connection through the compressor housing 20. The hermetic power terminal 18 includes connecting lugs 18*a*, 18*b* & 18*c* for connecting the input AC power line 16. In an alternate configuration, each AC line 18*a* or 18*b* may also be used with a start lead 18*c* connected as a common conductor. Thus, lines 18*a* and 18*c* or 18*b* and 18*c* may be used as the connection point to the output 14 of the converter 12. The input AC power line 16 is connected to the compressor motor 22 through the hermetic power terminal 18. The motor 22 has motor leads 24 connected to the hermetic power terminal 18 inside the housing 20.

Figure 6:
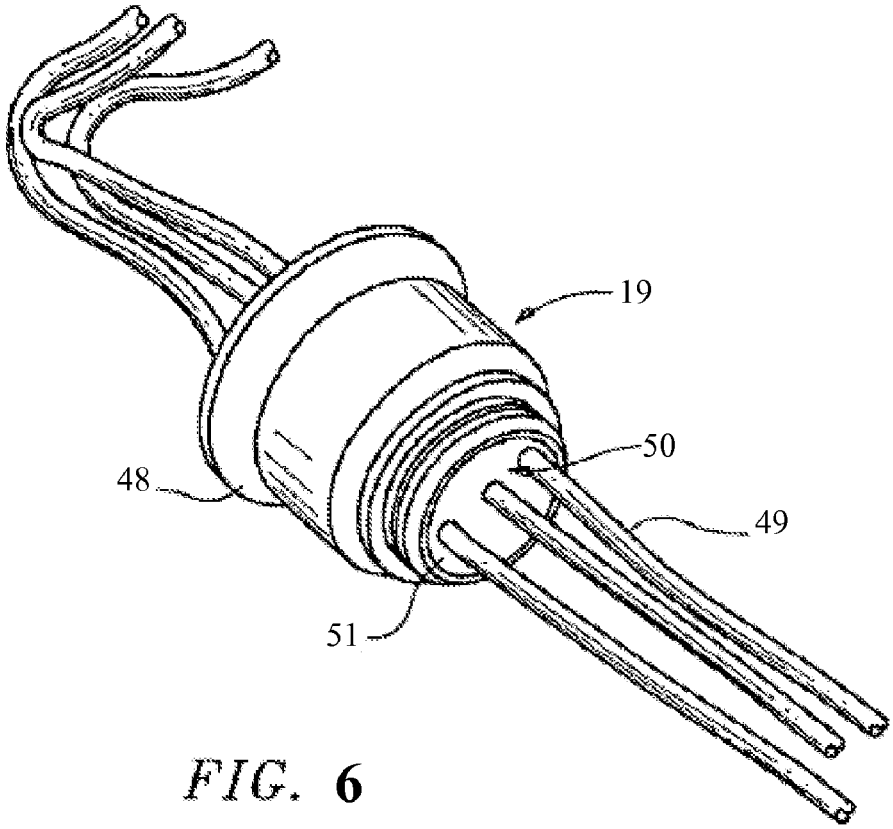
FIG. 6 shows an outer perspective view of an electrical feedthrough assembly.

FIG. 5 is similar to FIG. 4 except that the hermetic power terminals are hermetic feedthrough terminals 19. The hermetic feedthrough terminals 19 provide a sealed connection through the hermetic compressor housing 20. The hermetic feedthrough terminals 19 can incorporate the motor leads 24 in the compressor housing 20. As shown in FIG. 6, the feedthrough terminals or assembly 19 includes a weld housing 48 sealingly retaining a sealed wire or conductor assembly 50. The outer surface of the weld housing 48 is hermetically welded within an opening of the housing 20. A plurality of wires or conductors 49 are embedded in a body 51 and extend through the wire assembly 50 to interconnect electrical components, e.g., motor 22, within the housing 20 with electrical components, e.g., AC power supply 102, outside the housing 20. One embodiment of hermetic feedthrough terminals is described in U.S. Pat. No. 7,763,808, which patent is incorporated by reference herein. Other sealed connections for penetrating the hermetic housing 20 may also be employed, such as by way of example and not limitation, airtight packing glands or conduit connectors capable of maintaining an airtight seal when exposed to the internal pressures generated by the compressor.

Inside the compressor housing 20, a decoder or driver 28 is connected to motor leads 24 via control lines 32 using the same conductors or phases of the AC input power lines 16 as the output 14 of the converter 12. The decoder 28 can receive the output signal or instruction from the converter 12 on the AC power line 16 and convert the output signal to a control signal understood by the internal component(s) of the compressor 34.

In one exemplary embodiment, the signal S is input to the encoder or converter 12 from the control panel 108, to control a component of the compressor 34. Signal S is provided to the AC power lines 16 via converter 12 through output lines 14. The encoder or converter 12 converts signal S from a low frequency signal, e.g., 50 Hz or 60 Hz, to a high frequency signal, e.g., 10 KHz-100 MHz. In one embodiment, the higher the frequency of the output signal from the encoder 12, the smaller the coupling capacitors that are required by the encoder 12 and decoder 28 to isolate the output of the converter 12 from the AC power supply. Those skilled in the art will appreciate that there are many known methods of modulating the high frequency signal, for example, frequency modulation (FM), amplitude modulation (AM), burst or digital encoding, and other methods of modulation may be employed. Signal S can be a low power level signal relative to the power level provided to the motor 22.

The output signal from the encoder 12, which corresponds to signal S, is transmitted on AC power lines 16 through the hermetic power terminals 18 or 19, and into the housing 20 on motor leads 24. The decoder or driver 28 receives the output signal from the converter 12 and generates a driver signal D or suitable control signal to the component, e.g., solenoid valve 26, in response to the output signal from the converter 12, which corresponds to signal S, being detected by decoder or driver 28.

In the embodiments shown in FIGS. 4 and 5, the decoder or driver 28 can be connected to an electromagnetic coil 30 for the solenoid valve 26. When the electromagnetic coil 30 of the normally closed solenoid valve 26 is energized, the valve 26 is opened to modulate the capacity of the compressor. The driver signal D continues to energize the solenoid valve 26 until signal S is removed from converter 12 by the control algorithm executed by the control panel or controller. When signal S is removed, the solenoid valve 26 closes. In an alternate embodiment, a solid-state or sealed contact switch (not shown) may be used to energize the solenoid valve 26 by connecting the solenoid valve 26 across two phases of the motor AC input mains 24, and actuating the switch via the output signal from converter 12.

In another embodiment, the control system may be used to operate other internal control devices of the compressor 34, such as a bleed valve for pressure equalization. FIG. 3 shows a bleed valve 37 in a pressure equalization system of a compressor 34. The normally open bleed valve 37 is in the closed state when the compressor 34 is operating, and open when the compressor 34 is not operating. The bleed valve 37 permits the equalization of pressure within the compressor 34 to facilitate startup and to eliminate the need for motor starting capacitors and start relays.

The bleed valve 37 of the pressure equalization system is positioned within a discharge muffler housing 44. The bleed valve 37, which can be a solenoid valve, is shown schematically at aperture 40. Aperture 40 provides a pressure bleed port between the high-pressure side of the compressor at muffler 44 and the low pressure side of the compressor at inlet 42. Various solenoid valve arrangements for use with the present application are described in commonly owned U.S. Pat. No. 6,584,791 and No. 6,823,686, both of which patents are hereby incorporated by reference.

Figure 7:
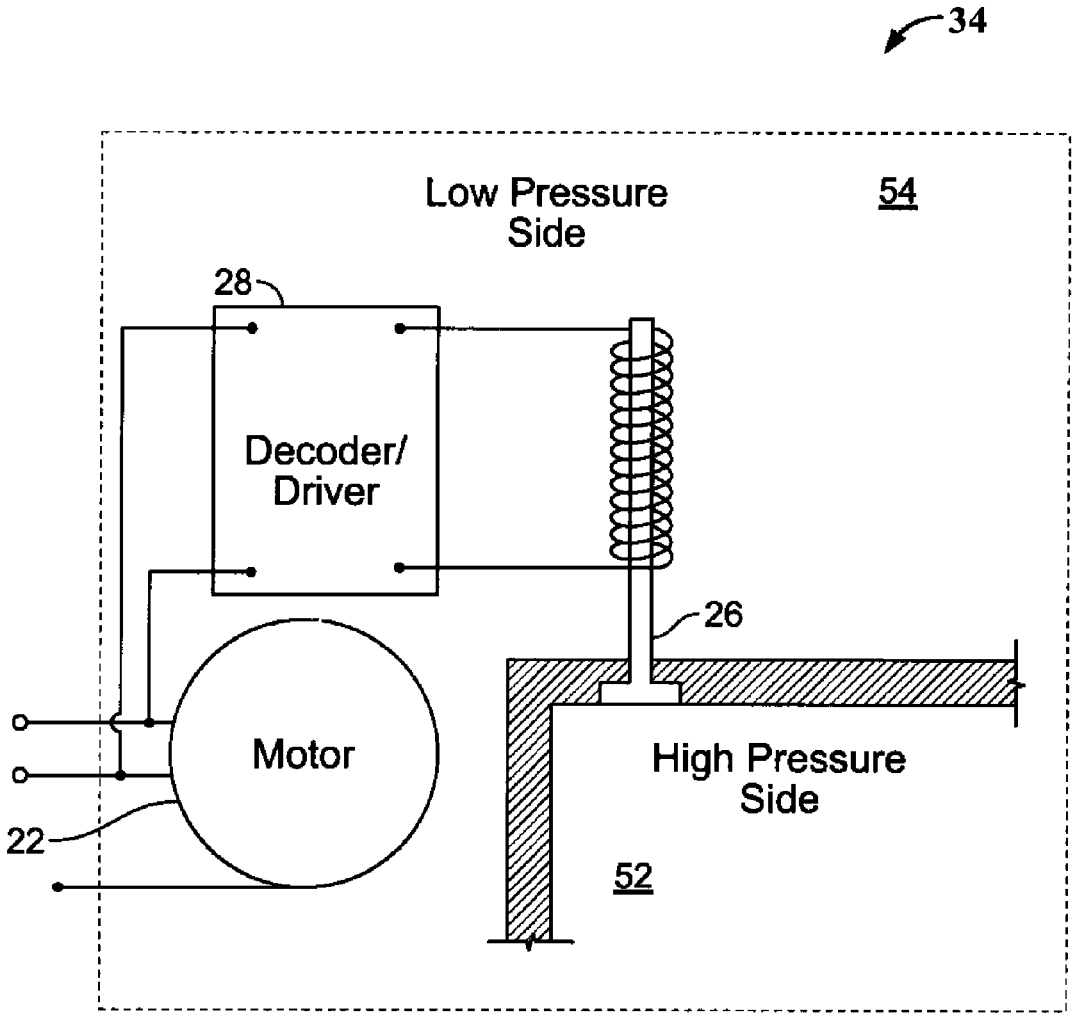
FIG. 7 schematically shows a solenoid-operated bleed valve for a pressure equalization system of a compressor.

In an exemplary embodiment shown in FIG. 7, compressor 34 includes a motor 22 having electrical leads that are connected to the AC input electrical power source for providing electrical power to the motor 22. A solenoid valve 26 is connected to the decoder/driver 28. The valve 26 is connected to the high pressure side 52 of the compressor 34. The term high pressure side 52 can refer to any portion of the compressor associated with high pressure fluid, such as the discharge side of the compression chamber, including the piston cylinder head, muffler, or shock loop. Preferably, when opened, the valve 26 permits high pressure fluid to flow to the low pressure side 54, such as the suction side of the compressor 34. The valve 26 can be normally open to permit the flow of high pressure fluid from the compressor high side elements to the compressor suction or low pressure side when the compressor 34 is not operating.

In an alternate embodiment, the valve 26 can be configured in the normally closed or "off" position to provide a substantially fluid tight seal to prevent the flow of high pressure fluid from the high pressure side 52 to the low pressure side 54. In the normally closed configuration, the valve 26 is pulsed open by a signal from the decoder/driver 28 for a short interval when the compressor is started. Once the valve 26 opens, high-pressure fluid from the high-pressure side 52 of the compressor flows to the low-pressure side 54, the valve 26 being sufficiently sized to permit a rapid change in pressure toward equalization. After this change in pressure occurs, the motor 22 can then accelerate to its operating speed requiring substantially reduced starting torque. After a time delay in which the motor may reach its operating speed, the valve 26 closes in response to a driver signal D from the decoder/driver 28. The housing 20 must be sufficiently sized, along with other considerations, such as valve actuation delay, to ensure the housing 20 does not become overly pressurized before the motor has reached its operating speed.

In one exemplary embodiment, the control system can use an encoder/decoder device that can both send and receive signals on the AC power lines 16. By using an encoder/decoder device, information from within the compressor, e.g., sensor measurements such as temperature, pressure, voltage, current, speed, resistance, or rotor position, can be sent back to the control panel to enhance the operation of the compressor.

In another exemplary embodiment where the motor drive 114 is located inside the compressor housing 20, the decoder 28 can be incorporated into the motor drive and directly decode the signals from the converter 12 on the AC power lines 16. The output signals from the converter 12 can be decoded and used to control the output power provided by the motor drive 114 to the motor 22.

In one exemplary embodiment, the encoder 12 and decoder 28 can be configured to control multiple components inside the compressor housing 20. To be able to identify the different components inside the compressor housing 20 to be controlled, each component can have a unique identifier that can be incorporated into the output signal from the encoder 12 and included in control signal S. The decoder 28, upon receiving the output signal from the encoder 12, can determine the unique identifier and then distribute the control signal to the appropriate component.

It should be understood that the application is not limited to the details or methodology set forth in the following description or shown in the figures. It should also be understood that the phraseology and terminology employed herein is for the purpose of description only and should not be regarded as limiting.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A system for transmitting control signals to internal components of a compressor, wherein the compressor comprises a hermetically sealed housing and a motor positioned inside the hermetically sealed housing, the system comprising:

a first signal converter located external to the hermetically sealed housing, the first signal converter being configured to receive a control signal and convert the control signal to an output signal;

a second signal converter located internal to the hermetically sealed housing, the second signal converter being configured to decode the output signal and generate a control signal for an internal component of the compressor;

a power terminal configured and positioned to provide a hermetically sealed electrical connection through the housing;

a plurality of power lines connectable to a power source to provide an operating voltage to the motor, the plurality of power lines connected to the power terminal external to the hermetically sealed housing;

a plurality of motor leads positioned inside the hermetically sealed housing, the plurality of motor leads connected to the power terminal at one end and to the motor at an opposite end;

the first signal converter is electrically coupled to at least one power line of the plurality of power lines to transmit the output signal through the at least one power line and the power terminal to the plurality of motor leads; and the second signal converter is electrically coupled to at least one motor lead of the plurality of motor leads to receive the output signal and the at least one motor lead is connected to the power terminal at a location corresponding to the connection of the at least one power line of the plurality of power lines to the power terminal.

2. The system of claim 1 wherein the power source is an AC power source configured to provide a voltage greater than 100 volts.

3. The system of claim 2 wherein the AC power source is a multi-phase AC power source and the first signal converter and the second signal converter are each connected across two corresponding phases of the multi-phase AC power source.

4. The system of claim 2 wherein the AC power source is a single phase AC power source and the first signal converter and the second signal converter are each connected between two corresponding conductors associated with the single phase AC power source.

5. The system of claim 1 wherein the first signal converter converts the received control signal using a technique selected from the group consisting of frequency modulation, amplitude modulation, burst encoding and digital encoding.

6. The system of claim 1 wherein the second signal converter is configured to receive a sensor signal from a sensor internal to the hermetically sealed housing and convert the sensor signal to a second output signal and the first signal converter is configured to decode the second output signal and generate a corresponding signal for a controller.

7. The system of claim 1 wherein the internal component of the compressor is a solenoid valve configured to modulate compressor capacity in response to the generated control signal from the second signal converter.

8. The system of claim 1 wherein the internal component of the compressor is a solenoid valve configured to equalize pressure in the hermetically sealed housing in response to the generated control signal from the second signal converter.

9. The system of claim 1 wherein the output signal from the first signal converter has a frequency in the range between about 10 KHz and about 100 MHz.

10. A system comprising:

a compressor, the compressor comprising a hermetically sealed housing, a motor positioned in the hermetically sealed housing, and a hermetic power terminal configured and positioned to provide a sealed electrical connection through the hermetically sealed housing;

a plurality of first power lines connectable to an AC power source at one end and connected to the hermetic power terminal at an opposite end, the AC power source being configured to provide a voltage greater than 100 volts;

an encoder located external to the hermetically sealed housing, the encoder configured to receive a first signal and convert the first signal to a second signal, the encoder being connected to at least one first power line of the plurality of first power lines to transmit the second signal on the at least one first power line;

a plurality of second power lines positioned inside the hermetically sealed housing, the plurality of second power lines connected to the hermetic power terminal;

a decoder located internal to the hermetically sealed housing, the decoder being connected to at least one second power line of the plurality of second power lines to receive the second signal from the at least one second power line, the decoder configured to receive the second signal and generate a third signal from the second signal, the third signal corresponding to the first signal;

a component located internal to the hermetically sealed housing and controlled by the third signal from the decoder; and the connection of the at least one first power line to the power terminal corresponds to the connection of the at least one second power line to the power terminal.

11. The system of claim 10 wherein the component comprises a motor drive to provide power to the motor, the plurality of second power lines being connected to the motor drive.

12. The system of claim 10 wherein the component comprises one of a solenoid valve, a modulating device or a heater.

13. The system of claim 10 wherein the hermetic power terminal comprises a feedthrough terminal.

14. The system of claim 10 wherein the AC power source is a multi-phase AC power source and the encoder and the decoder are each connected across two corresponding phases of the multi-phase AC power source.

15. The system of claim 10 wherein the AC power source is a single phase AC power source and the encoder and the decoder are each connected between two corresponding conductors associated with the single phase AC power source.

16. The system of claim 10 wherein the encoder converts the first signal using a technique selected from the group consisting of frequency modulation, amplitude modulation, burst encoding and digital encoding.

17. The system of claim 10 wherein the decoder is configured to receive a sensor signal from a sensor internal to the hermetically sealed housing and convert the sensor signal to an output signal and the encoder is configured to decode the output signal and generate a corresponding signal for a controller.

18. The system of claim 17 wherein the sensor signal corresponds to one of temperature, pressure, voltage, current, resistance or rotor position.

19. The system of claim 10 wherein the hermetically sealed housing contains refrigerant at a pressure greater than atmospheric pressure.

20. A method for controlling an internal device of a hermetic compressor, wherein the compressor includes a housing, a hermetic power terminal providing an electric connection through the housing and a motor positioned in the housing, the method comprising:

receiving a control signal for an internal device of a hermetic compressor;

converting the control signal to an output signal at a location external to a housing of the hermetic compressor, the output signal having a frequency in the range between about 10 KHz and about 100 MHz;

transmitting the output signal on an AC power line through a hermetic power terminal into the interior of the housing;

receiving the output signal at a location internal to the housing;

generating a driver signal based on the received output signal; and controlling the internal device of the hermetic compressor using the generated driver signal.

* * * * *